US010065758B2

(12) United States Patent
De La Serna

(10) Patent No.: US 10,065,758 B2
(45) Date of Patent: Sep. 4, 2018

(54) DEVICE, USE OF DEVICE AND METHOD FOR APPLYING LABELS TO WRAPPED PRODUCTS

(71) Applicant: SICPA HOLDING SA, Prilly (CH)

(72) Inventor: Alberto De La Serna, Woodridge, IL (US)

(73) Assignee: SICPA HOLDING SA, Prilly (CH)

( * ) Notice: Subject to any disclaimer, the term of this patent is extended or adjusted under 35 U.S.C. 154(b) by 421 days.

(21) Appl. No.: 14/881,512

(22) Filed: Oct. 13, 2015

(65) Prior Publication Data

US 2016/0101886 A1 Apr. 14, 2016

Related U.S. Application Data

(60) Provisional application No. 62/063,672, filed on Oct. 14, 2014.

(51) Int. Cl.

| | |
|---|---|
| ***B65B 61/00*** | (2006.01) |
| ***B65B 61/06*** | (2006.01) |
| ***B65C 3/10*** | (2006.01) |

(52) U.S. Cl.

CPC ..... *B65B 61/005* (2013.01); *B65B 61/06* (2013.01); *B65C 3/105* (2013.01)

(58) Field of Classification Search

CPC ..... B65B 61/005; B65B 61/02; B65B 61/26; B26D 1/045; B26D 1/085; B26D 1/305; B43M 7/00; B43M 7/002; B43M 7/007

USPC .... 53/135.1, 136.1, 556, 532, 540; 493/910, 493/911, 917, 919; 383/202, 203, 204, 5, 383/167, 425

See application file for complete search history.

(56) References Cited

U.S. PATENT DOCUMENTS

| | | | | |
|---|---|---|---|---|
| 2,266,629 | A * | 12/1941 | Flynn | B43M 7/007 83/167 |
| 2,302,855 | A * | 11/1942 | Hallman | B26D 7/1818 83/100 |
| 3,106,121 | A * | 10/1963 | Novick | B31B 50/00 83/152 |
| 3,479,912 | A * | 11/1969 | Kennedy | B43M 7/00 83/176 |
| 4,873,767 | A * | 10/1989 | Lok | B26B 27/00 30/278 |
| 5,372,054 | A * | 12/1994 | Federighi, Sr. | B67B 7/0405 30/1.5 |
| 6,247,843 | B1 * | 6/2001 | Buchman | B65D 33/2591 383/202 |
| 6,370,842 | B1 * | 4/2002 | Moriyama | B32B 27/10 53/412 |
| 6,422,283 | B1 * | 7/2002 | Okushita | B29C 69/006 156/264 |
| 2007/0090144 | A1 * | 4/2007 | Kazama | B26D 1/385 225/43 |
| 2007/0102106 | A1 * | 5/2007 | Kingsford | A61B 5/02233 156/244.11 |

(Continued)

*Primary Examiner* — Hemant M Desai
*Assistant Examiner* — Valentin Neacsu
(74) *Attorney, Agent, or Firm* — Muncy, Geissler, Olds & Lowe, P.C.

(57) ABSTRACT

An apparatus that includes a support for one or more products. The one or more products have a wrapping thereabout, and a cutter is coupled to the support and moveable relative to the support for forming a window in the wrapping to allow access for placing one or more labels on the one or more products.

28 Claims, 4 Drawing Sheets

(56) References Cited

U.S. PATENT DOCUMENTS

| | | | | |
|---|---|---|---|---|
| 2007/0267433 | A1* | 11/2007 | Fuisz | B26D 7/00 221/45 |
| 2009/0094842 | A1* | 4/2009 | Yoo | B26D 1/245 30/290 |
| 2012/0152078 | A1* | 6/2012 | Benard | B43M 7/00 83/434 |

* cited by examiner

DEVICE, USE OF DEVICE AND METHOD FOR APPLYING LABELS TO WRAPPED PRODUCTS

CROSS-REFERENCE TO RELATED APPLICATION

The present application claims the benefit under 35 U.S.C. § 119(e) of U.S. Provisional Application No. 62/063,672 filed Oct. 14, 2014, the disclosure of which is expressly incorporated by reference herein in its entirety.

BACKGROUND OF THE DISCLOSURE

1. Field of the Disclosure

The present disclosure relates to application of labels to products that have a wrapping applied to them.

2. Background Description

It may be desirable to apply labels to products downstream in the supply chain from when a wrapping has been applied to the products. The wrapping will prevent access to the products, so that labels will not be able to be applied to products covered by the wrapping.

Dipping tobacco and snuff can be supplied in wrapped bundles of multiple tins or cans. Different jurisdictions will wish to apply a tax label to each of the tins or cans, but the wrapping does not provide access to the underlying tins and cans to allow such a labelling process.

It is an aim of the present disclosure to provide method and device and use of the device for applying labels to one or more products underlying wrapping about the one or more products.

SUMMARY OF THE DISCLOSURE

In a first aspect, the present disclosure provides an apparatus comprising a support for one or more products having a wrapping thereabout, and a cutter coupled to the support and moveable relative to the support for forming a window in the wrapping to allow access for placing one or more labels on the one or more products.

Formation of a window to provide access is advantageous as compared to removing the whole wrapping. Firstly, the window can be sized to ensure that the wrapping still functions. Secondly, if the wrapping is removed, then a wrapping other than the manufacturer's original wrapping would have to be applied. This is not desirable for branding purposes from one perspective. In another perspective, it is not desirable as there are material waste and additional processing steps in re-wrapping the products.

Use of the apparatus is also provided in a second aspect of the present disclosure. In use, the cutter is moved relative to the support to form at least part of the window in the wrapping. The labels are applied to the underlying products by access through the window.

In an alternative embodiment of the first aspect, there is provided an apparatus comprising a support for one or more products, the one or more products having a wrapping thereabout, and a cutter movable relative to the support for forming a window in the wrapping. The below mentioned embodiments according to the first aspect as detailed above are equally relevant to the alternative embodiment of the first aspect.

In a second aspect, the present disclosure provides a method, comprising providing one or more products having a wrapping thereabout, forming a window in the wrapping and applying one or more labels on the one or more products through access provided by the window.

In an embodiment of the first and second aspects, the support is able to hold the products stationary relative thereto.

In an alternative embodiment of the first and second aspects, the feature of the cutter being moveable relative to the support could be implemented by way of the cutter being stationary and the support being moveable. For example, the support could comprise a conveyor able to convey the one or products to the cutter and affect the relative movement between the cutter and the products to form the window. In an embodiment of the first and second aspects, the support is provided substantially in the form of a trough, wherein at least two sides of the trough are configured to support the products from at least two sides and wherein at least one side of the trough is configured to allow access to the wrapping for the cutter. In an embodiment of the second aspect, the products are placed in the trough and the cutter is moved into contact with a part of the products exposed by the open side to form the window.

Use of a substantially trough shaped support is advantageous since the accuracy of the cut forming the window may be improved when the products about which the wrapping is disposed are stable.

Use of the apparatus according to the above embodiment is also provided. In use, the at least two sides of the trough support the products when the cutter is moved relative to the support to form the window in the wrapping.

In another embodiment of the first and second aspects, the cutter comprises at least one blade that is arranged to be moved into cutting relation with the wrapping to cut through the wrapping and thereafter configured to be moved relative to the products to extend the cut in the wrapping to form at least part of the window.

Alternatively stated, in an embodiment of the present disclosure, the cutter is arranged to pierce the wrapping at one or more locations and the apparatus is configured to relatively move the products and the cutter to extend the piercing to form at least part of the window. The extension of the piercing at one or more locations may form one or more cut lines forming one or more sides of the window. In an embodiment, the cutter is arranged to simultaneously form opposed cut lines during relative movement of the cutter and the products, wherein the opposed cut lines form longitudinal sides of the window (i.e., longer sides of the window as compared a shorter lateral dimension of the window).

Use of a blade in the cutter is advantageous since the cost of the cutter may be reduced when compared to more complex cutting devices.

Use of the apparatus according to the above embodiment is also provided. In use, the blade is moved into cutting relation with the wrapping. The blade then cuts through the wrapping, and is then moved relative to the products to extend the cut in the wrapping, thereby forming at least part of the window in the wrapping.

In an embodiment of the first and second aspects, the cutter includes first and second blades to form opposed sides of the window. In an embodiment of the second aspect, the first and second blades are moved relative to the product to cut the opposed sides of the window. The opposed sides of the window can thus be cut simultaneously. In an embodiment of the first and second aspects, the first and second blades are arranged to be brought into cutting relation with the wrapping and to be moved in tandem relative to the products to form parallel cut lines forming opposed sides of the window. In an embodiment of the second aspect, the first and second blades are brought into cutting relation with the wrapping and moved, relatively, along the products in tandem to form parallel cut lines.

Provision of multiple blades on the cutter head to form opposed sides of the window is advantageous since the time taken to form the window is reduced. Provision of multiple blades on the cutter head to form opposed sides of the window is also advantageous since the wear on each blade to form one window is also reduced.

Use of the apparatus according to the above embodiment is also provided. In use, the first and second blades are moved relative to the opposed sides of the window to be brought into cutting relation with the wrapping. The blades then cut through the wrapping. The blades are then moved relative to the wrapping to extend the cut in the wrapping, thereby forming cut lines forming opposed sides of the window.

In an embodiment of the first and second aspects, the cutter comprises a leading blade, wherein the leading blade is arranged to cut perpendicular to the movement direction of the cutter.

Provision of a leading blade that is arranged to cut perpendicular to the movement direction of the cutter is advantageous, since a cut perpendicular to the movement direction of the cutter can be made without increasing the complexity of the overall apparatus.

Use of the apparatus according to the above embodiment is also provided. In use, the cutter is moved, relative to the products, over the wrapping. The leading blade then cuts the wrapping in a direction perpendicular to the relative movement direction of the cutter and the products.

In a further embodiment in accordance with the previous embodiment, the leading blade is movable between a first position where the leading blade is not in contact with the wrapping and a second position where the leading blade is in contact with the wrapping.

Provision of a leading blade that is selectively in contact with the wrapping is advantageous as the risk of damage to the wrapping during movement of the cutter over the wrapping is reduced.

Use of the apparatus according to the above embodiment is also provided. In use, the leading blade is maintained in a first position where the leading blade is not in contact with the wrapping when the cutter is moved over the wrapping. The leading blade is then moved into a second position where the leading blade is in contact with the wrapping. The leading blade then forms a cut perpendicular to the relative movement direction of the cutter and the products to form at least one side of the window in the wrapping. The leading blade may then optionally be moved back into the first position where the leading blade is not in contact with the wrapping.

In an embodiment of the first and second aspects, the apparatus is configured to allow the blade that forms a cut parallel to the direction of relative movement of the cutter and the products to be moved out of engagement with the wrapping when the blade that forms a cut perpendicular to the movement of the cutter is moved into engagement with the wrapping. In an alternative embodiment, both the blade that forms a cut parallel to the direction of relative movement of the cutter and the products, and the blade that forms a cut perpendicular to the movement of the cutter are biased away from the wrapping. In this embodiment, pressure on different, specific locations on the cutter is required to bring either the blade that forms a cut parallel to the direction of relative movement of the cutter and the products, or the blade that forms a cut perpendicular to the direction of relative movement of the cutter and the products into engagement with the wrapping.

In an embodiment of the first and second aspects, the apparatus further comprises a rotatable shaft or other rotator configured to rotate the one or more products. The one or more products have a wrapping thereabout.

The provision of a rotatable shaft or other rotator is advantageous since it allows the wrapping about the one or more products to be cut perpendicular to the movement direction of the cutter in a mechanically simple way, to improve the overall reliability of the apparatus.

Use of the apparatus according to the above embodiment is also provided. In use, the rotatable shaft or other rotator is moved to rotatably couple to the one or more products. The rotatable shaft or other rotator is then rotated. The rotation of the rotatable shaft or other rotator transfers to the one or more products to rotate the one or more products.

In an embodiment according to some of the above embodiments, rotation of the one or more products having a wrapping thereabout allows the wrapping to be cut by the leading blade, when the leading blade is in the second position.

The above configuration is advantageous, since this configuration allows a perpendicular cut to be formed in the wrapping to form a window in a mechanically non-complex manner, thereby improving the reliability of the device.

Use of the apparatus according to the above embodiment is also provided. In use, the leading blade is maintained in a first position where the leading blade is not in contact with the wrapping when the cutter is moved, relatively, over the wrapping. The rotatable shaft or other rotator is then rotatably coupled to the one or more products having a wrapping thereabout. The leading blade is then moved into a second position where the leading blade is in contact with the wrapping. The rotatable shaft or other rotator is then rotated. In response to the rotation of the rotatable shaft or other rotator, the one or more products having wrapping thereabout is rotated. As a consequence of the rotation of the one or more products having a wrapping thereabout, the leading blade forms a cut perpendicular to the movement direction of the cutter to form at least one side of the window in the wrapping. The leading blade may then optionally be moved back into the first position where the leading blade is not in contact with the wrapping.

In an embodiment of the first and second aspects, the cutter comprises first, second and third blades, wherein the first and second blades are arranged to form opposed sides of the window and the third blade is arranged to form a cut extending perpendicularly to, and connecting, the cuts made by, or that will be made by, the first and second blades to form a flap of the wrapping that allows the window to be opened to provide access to the underlying products. In an embodiment of the second aspect, the first and second blades are moved relative to the products to cut the wrapping and form opposed sides of the window and the third blade is used to cut the wrapping so as to connect cuts made by, or that will be made by, the first and second blades to form the window as a flap of wrapping, and opening the flap to provide the access to the underlying products.

Provision of an apparatus of the above embodiment advantageously provides an apparatus that is able to cut a window in wrapping about one or more products in a reliable and non-expensive manner.

In use, the cutter is moved, relatively, over the wrapping about the one or more products, thereby bringing the first and second blades into cutting relation with the wrapping. Further relative movement of the cutter over the wrapping extends cuts forming opposed sides of the window in the wrapping. After these cuts forming opposed sides of the window in the wrapping have been formed, the third blade cuts in a direction perpendicular to the movement direction of the cutter. The cut made by the third blade connects the cuts made by the first and second blades. The resulting three cuts form a flap of the wrapping that allows the window to be opened to provide access to the underlying products.

In an embodiment of the first and second aspects, the cutter comprises a head upon which at least one blade is mounted and which is moveable relative to the products when placed in the support in order to create at least part of the window. In an embodiment of the second aspect, the head is moved relative to the products thereby cutting at least part of the window. In an embodiment of the first and second aspects, the head comprises at least two, preferably three, blades to cut respective parts of the window. In an embodiment of the second aspect, the head is moved relative to the products and the at least two blades are brought into cutting relation with the wrapping to thereby form respective parts of the window.

In an embodiment of the first and second aspects, the cutter includes at least a first blade and a third blade, wherein the first and third blades are arranged for making cuts perpendicular to one another, wherein the first blade is arranged to form a cut line upon translation of the cutter relative to the support and the products, wherein the cutter is arranged so that the third blade is set back relative to the first blade so that the wrapping can be cut with the first blade without interference from the third blade, and wherein the cutter is arranged so that the third blade is able to be moved relative to the first blade to be brought into contacting relation with the wrapping. In an embodiment, the cutter is able to be rocked, pivoted or otherwise tilted to bring the third blade into contacting relation with the wrapping. Alternatively, the third blade may be moveable between set-back and extended positions to bring the third blade into cutting relation with the wrapping. In an embodiment of the second aspect, the cutter is used by moving it in cutting relation with the wrapping to create a slit with the first blade while the third blade is set back relative to the wrapping and manipulating the cutter to create a perpendicular slit with the third blade, thereby forming at least two sides of the window.

In an embodiment of the first and second aspects, the cutter is arranged to be moved into cutting relation with the wrapping to form the window and is able to be moved into an out-of-the-way position to provide access for applying the labels. The out-of-the-way position is a position not overlapping with the one or more products. In an embodiment of the second aspect, the cutter is moved from an out-of-the-way position into a cutting position to form the window and is returned to the out-of-the-way position whereby the labels are applied through the access provided by the window. Alternatively, the support is configured to move the products into a position at which the cutter operable on the wrapping to form the window and the support is configured to move the products into a position away from the cutter, at which the labels are applicable to the products through the window.

In an embodiment of the first and second aspects, the apparatus comprises one or more guides for guiding movement of the cutter in forming at least part of the window. In an embodiment of the second aspect, the cutter is moved along the guides to form at least part of the window in the wrapping. In an embodiment, the one or more guides comprises one or more guide rails along which the cutter is moveable. In an embodiment of the first and second aspects, the one or more guides and the cutter are arranged such that the cutter is moveable along the guides to form at least three sides of the window. In an embodiment of the second aspect, the cutter is moved along the one or more guides and three sides of the window are cut. In an embodiment, the three sides of the window form a flap that is connected to the rest of the wrapping to allow the flap to be opened for application of the one or more labels and reclosed thereafter.

In an embodiment of the first and second aspects, the cutter is coupled to the support to allow for relative movement therebetween along a plane relative to the products to form at least part of the window, yet held stable in height relative to the plane to control depth of cut in the wrapping. In an embodiment of the second aspect, the cutter is moved relative to the support and the products along the plane to cut at least part of the window while the coupling with the support assists in maintaining stability of the depth of cut.

Provision of coupling of the cutter to the support allows for a stable cut during formation of the window.

The term "coupling" may describe both direct and indirect coupling of the cutter to the support. Indirect coupling encompasses coupling through a plurality of intermediate integers.

In a preferred embodiment, the cutter is directly coupled to the support, e.g., the cutter is mounted to one or more guide rails, which are mounted to the support so that the guide rails provide a direct coupling therebetween.

In an embodiment of the first and second aspects, the cutter is translatable on a guide along the support and the products at a height guided by the guide of the apparatus. In an embodiment of the second aspect, the cutter is translated along the products to cut at least part of the window and at a height guided by the guide.

Provision of a guide advantageously improves the accuracy of the cut made by the cutter.

In an embodiment of the first and second aspects, the cutter is configured to be moved relative to the support and the products along a single axis or along a single motion in one direction in order to create at least two sides of the window. The single axis may be parallel with an axis of extension of the support and the products. Straight and curved axis can be envisaged. A guide may be included to define the axis of movement of the cutter.

In a third aspect of the present disclosure, there is provided a method comprising one or more products having a wrapping thereabout, forming a window in the wrapping, and applying one or more labels on the one or more products through the window.

During movement of a bundle of wrapped products into new jurisdictions, different jurisdictions usually apply a unique tax label to each individual tin or can in the bundle. A less desirable practice of applying these individual, unique labels would be by unwrapping the bundle of tins or cans, discarding the wrapping, applying the labels to each tin or can, and then re-wrapping the bundle of tins or cans in new wrapping. However, the inventor of the present disclosure spotted a problem in such a method of applying these labels individually. Specifically, the inventor realized that such a manner of applying these labels leads to a large amount of wrapping material being used. The inventor therefore conducted research and extensive design work in order to overcome this problem. During this extensive research and design work, the inventor discovered that the known solution to this problem, namely unwrapping the wrapping, applying the labels, and then rewrapping the wrapping, was too time-consuming. Upon realization of this further problem, the inventor then conducted research into how to reduce the wrapping used during labelling of products in a supply chain whilst still allowing the labelling process to be performed quickly. It is therefore an aim of the present disclosure to reduce the amount of wrapping used during labelling of products throughout a supply chain. It is a further aim of the present disclosure to provide methods and devices for efficiently applying labels to one or more products underlying wrapping about the one or more products. These aims are met by the present method in that a window is formed rather than the whole previous package being discarded. The window allows the labels to be applied, without requiring a re-wrapping step, thereby providing an efficient process.

In an embodiment of the third aspect, the providing step comprises placing the wrapped products in a support for holding the wrapped products in place during the forming step. In an embodiment, the products are held in place by the support laterally, and a cutter and the products are relatively moved longitudinally in order to form the window by cutting with the cutter.

In an embodiment of the third aspect, the forming step comprises forming a flap and opening the flap relative to the wrapping to provide access for applying the labels to the underlying products. The flap may be in strip form. The flap may be reclosed and attached to reclose the wrapping. The attaching could involve applying a film, such as an adhesive film, e.g., adhesive tape.

In an embodiment of the third aspect, the forming step comprises cutting at least three sides of a window in the wrapping.

In an embodiment of the third aspect, the forming step comprises forming the window in such a way as to maintain the wrapping about the one or more products. The wrapping may be maintained in a tight wrapping about the one or more products. In an embodiment of the third aspect, the one or more products comprises a plurality of products, the wrapping holds together the plurality of products and the window is formed so as to maintain the wrapping holding the products together. The window may be sized so that the wrapping remains disposed about a majority of the periphery of the products at the location of the window. The wrapping may extend fully about the products prior to cutting and the window is sized so as to remove less than 50%, 40%, 30%, or 20% of a full extent of the wrapping about the products. The wrapping extends about the products and along the products. The window may extend only partially along the wrapping so as to leave a connecting portion in the wrapping at one or both ends to keep the wrapping as extending fully about the products at least at the connecting portion or portions.

In an embodiment of the third aspect, the label applying step may comprise applying, e.g., adhering, a label on each of the products underlying the wrapping. The one or more products may comprise a plurality of products, and the window provides access to each of the products for application of a label to each of the products.

In an embodiment of the third aspect, the forming step comprises cutting a strip of the wrapping to form the window in the wrapping.

In an embodiment of the third aspect, the window is closed after the labels have been applied. Closing of the window may comprise at least partly covering the window with further material. The further material may comprise adhesive tape.

In an embodiment of the third aspect, the window may be formed by cutting the wrapping, and the method may comprise opening the cut portion of the wrapping to provide the access for applying the one or more labels. The cut portion of the wrapping may be reclosed and attached to the surrounding wrapping to reclose the window. The cut portion may be attached by applying adhesive material such as adhesive tape.

In an embodiment of the third aspect, the window may be formed by cutting a flap in the wrapping, and the method may comprise opening the flap to provide access for applying the labels, applying the labels through the access, and reclosing the flap to cover the access. The reclosed flap may be secured in place, for example, by application of adhesive material, such as, adhesive tape.

In an embodiment of the third aspect, the window may be formed by utilizing a cutting tool that allows at least two sides of the window, e.g., parallel cut lines, to be cut simultaneously. The two parallel cut lines are advantageously of the same length and having the starting and finishing points that are aligned along the wrapping.

In an embodiment of the third aspect, the window is formed using a cutting tool that allows at least two sides of the window to be cut by moving the cutting tool in a single direction.

In embodiments of the various aspects, the products are in the form of at least two, three, four, five, six, seven, eight, nine, or ten items that are bundled together in the wrapping.

In embodiments of the various aspects, the products are tinned or canned products. The tins or cans may be in the form of tin or can pucks. The tins or cans have a smaller height dimension than diameter dimension.

In embodiments of the various aspects, the products are stacked products, and plural products are held together in stacked configuration by the wrapping.

In embodiments of the various aspects, the products are tobacco products. The tobacco products may be canned or tinned. The cans or tins are preferably of puck form as described above but may be different sizes (e.g., have a heights dimension that is the same or greater than the diameter of the cans). The cans or tins may be bundled together in shrink wrapping, which shrink wrapping thus forms the aforementioned wrapping in which the window is formed. The tobacco products may be chewing tobacco, dipping tobacco, snuff, or the like, or other types of tobacco products.

In embodiments of the various aspects, the labels are tax labels.

In embodiments of the various aspects, the labels comprise at least one covert or overt security feature. The security feature may comprise an alphanumeric code, an image that changes with tilt angle, a hologram, intaglio printing, watermark, and combinations thereof.

In embodiments of the various aspects, the wrapping may comprise plastic film. The wrapping may be shrink wrapping. The products may be any kind of tobacco products bundled together in shrink wrapping.

In embodiments of the various aspects, the wrapping forms a sleeve about the one or more products.

In embodiments of the various aspects, plural products are held together by the wrapping. By holding together, it is meant longitudinally (e.g., when stacked), and laterally.

In some embodiments, the support is provided substantially in the form of a trough, wherein at least two sides of the trough are configured to support the one or more products from at least two sides, and wherein at least one side of the trough is structured and arranged to allow the cutter to access to the wrapping.

In some embodiments, the cutter comprises at least one blade that is arranged to be moved into cutting relation with the wrapping to form a cut through the wrapping, and configured to be moved thereafter relative to the products to extend the cut in the wrapping to form at least part of the window.

In some embodiments, the apparatus further comprises a rotatable shaft or other rotator configured to rotate the one or more products having the wrapping thereabout.

In some embodiments, the cutter comprises a head upon which at least one blade is mounted, the head is moveable relative to the products when arranged in the support in order to create at least part of the window, and the head comprises at least two blades to cut respective parts of the window as the head is moved relative to the products.

In some embodiments, the cutter is arranged to be moveable into cutting relation with the wrapping to form the window and is moveable into an out-of-the-way position to provide access for applying labels to the one or more products.

In some embodiments, the apparatus is configured to allow formation of only three sides of the window to form a flap that remains connected to the wrapping to allow the flap to be opened for application of one or more labels and reclosed thereafter.

In some embodiments, the method comprises moving the cutter relative to the support to form at least part of the window in the wrapping, and applying one or more labels to the underlying products through the window.

In some embodiments, the forming comprises forming a flap, and the method further comprises opening the flap relative to the wrapping to provide access for applying the one or more labels to the underlying one or more products.

In some embodiments, the one or more products comprises a plurality of products, the wrapping holds together the plurality of products before the window is formed, and the wrapping continues to hold together the plurality of products after the window is formed.

In some embodiments, the method further comprises closing the window after the labels have been applied.

In some embodiments, the forming the window comprises cutting the wrapping, and the method further comprises opening a cut portion of the wrapping to provide access for the applying the one or more labels.

In some embodiments, the method further comprises reclosing and attaching the cut portion of the wrapping to surrounding wrapping to reclose the window.

In some embodiments, the forming the window comprises cutting a flap in the wrapping, and the method further comprises opening the flap to provide access for the applying the labels, wherein the applying the labels is through the access, and reclosing the flap to cover the access.

In some embodiments, the products are in the form of at least four items that are bundled together in the wrapping, the products are tinned or canned products, the products are stacked products held together in a stacked configuration by the wrapping, and the wrapping comprises a sleeve about the products.

In some embodiments, the labels comprise tax labels.

In some embodiments, the opposed cut lines are parallel cut lines.

In some embodiments, the head comprises three blades.

In embodiments, the wrapping continues to hold together the plurality of products after the window is formed.

DETAILED DESCRIPTION OF EMBODIMENTS OF THE DISCLOSURE

Figure 1:
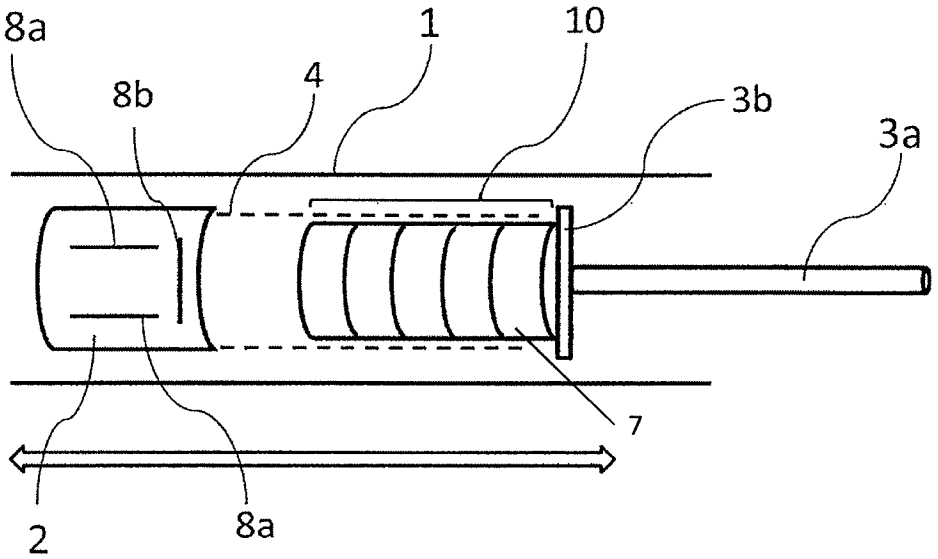
FIG. 1 shows a top view of an apparatus for forming a window in wrapping disposed about one or more products in accordance with aspects of the disclosure. The apparatus comprises a movable cutter that is able to cut three sides of the window to provide access for applying one or more labels on one or more underlying products.
Figure 2:
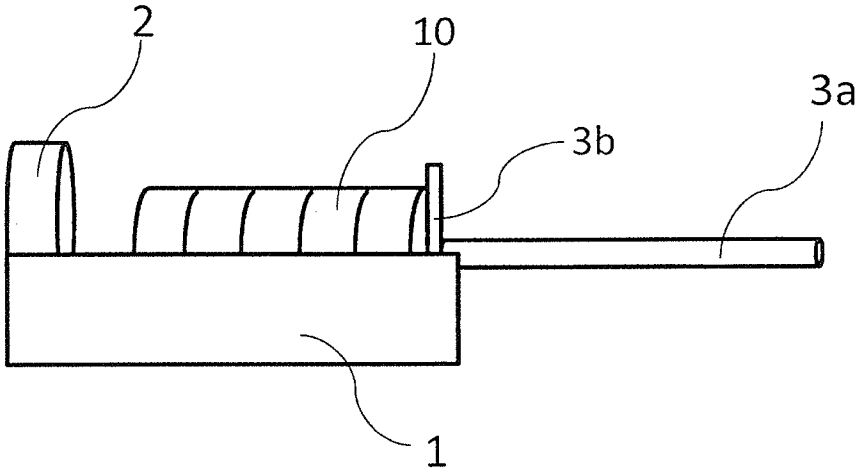
FIG. 2 shows a side view of the apparatus of FIG. 1 in accordance with aspects of the disclosure, in which a support for holding the one or more products can be seen in addition to the moveable cutter that moves relative to the support and the one or more products for cutting the window.
Figure 3:
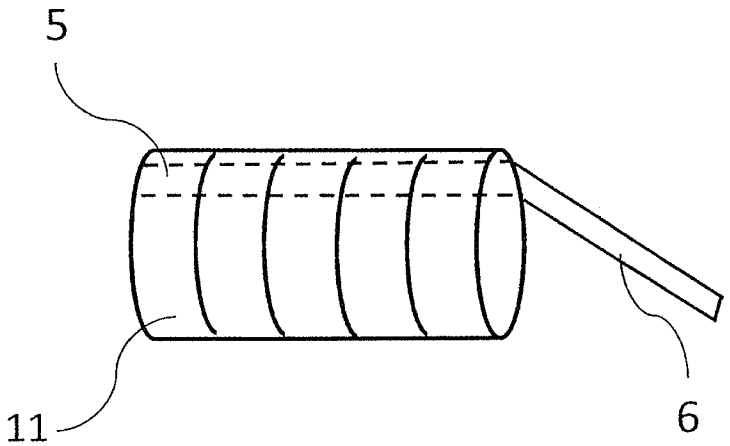
FIG. 3 shows plural products disposed within a wrapping in accordance with aspects of the disclosure. A window has been cut in the wrapping in such a way as to maintain the products held within the wrapping. The window has been cut to have three sides, with one side connected to the rest of the outer wrapping so as to provide the window in the form of a flap that is openable and re-closable relative to the rest of the wrapping and the underlying products.

Referring to FIGS. 1 and 2, there is shown a support 1 for holding a bundle of products 10. The bundle of products 10 comprises individual products 7 (see also FIG. 4) disposed within an outer wrapping 11 (FIG. 3). The support 1 is provided in the form of a trough having converging walls that tend to center the bundle of products 10 disposed therein. The bundle of products 10 has a longitudinal direction of extension going from left to right in FIGS. 1 to 3, which is also a direction in which the products 7 are stacked on top of one another. The bundle of products 10 also have a smaller lateral extension, which extends from top to bottom in FIGS. 1 to 3. A central longitudinal axis can be considered to extend through a center of each of the products 7 in the bundle of products 10.

The apparatus of the present embodiment further comprises a cutter comprising a cutter head 2 and a plurality of blades 8*a*, 8*b*. The cutter head 2 is coupled to the support 1 by a guide rail 4. The cutter head 2 is movable along the longitudinal axis of the bundle of products 10, which is also a movement along a longitudinal direction of the trough-like support 1. The rail guide 4 not only couples the support 1 and the cutter head 2, but also guides translation of the cutter head 2 forward and backward along the longitudinal axis.

The cutter head 2 comprises parallel blades 8*a* and a perpendicular blade 8*b*. The parallel blades 8*a* are disposed laterally with respect to the longitudinal axis so as to be able to create parallel cut lines, where these parallel cut lines extend along the longitudinal axis. The perpendicularly oriented blade 8*b* is provided for creating a laterally extending cut line that extends between the parallel extending cut lines created by the blades 8*a*. Thus, the blades 8*a*, 8*b* are each configured for cutting a respective side of a window in the wrapping 11 disposed about the one or more products 7. The blades 8*a* for creating the parallel cut lines project further in the direction of the bundle of products 10 than the blade 8*b* for creating the perpendicular cut line so that the cutter head 2 can be moved with respect to the bundle of products 10 to create the parallel cut lines without the blade 8*b* in contact with the wrapping 11. Pressure on the cutter head 2 can be adjusted by an operator to cause the blade 8*b* to extend further toward the bundle of products 10 in order to use the blade 8*b* to create the perpendicular cut line in the wrapping 11. In some embodiments, there may be a resilient bias provided by the cutter head 2 to bias the blades 8*a*, 8*b* away from engagement with the wrapping 11 when no downward pressure is applied to the cutter head 2. The cutter head 2 may tilt slightly when pressure is applied by an operator at the end of the cutter head 2 comprising the blade 8*b* to thereby allow adjustment of the projection of the blade 8*b* into contact with the wrapping 11 for creating a perpendicular cut line with respect to the parallel cut lines cut by the blades 8*a*. It may be the mounting of the cutter head 2 to the rail guide 4 that allows such tilting. Another envisaged mechanism is a slight flexibility in the material of the cutter head 2, for example.

The apparatus, in this specific embodiment, also comprises a rotatable shaft 3*a* having a plate 3*b* fixed thereto. The plate 3*b* is longitudinally fixed to the support 1 during movement of the cutter head 2. The plate 3*b* provides a stop at one longitudinal end of the bundle of products 10. The cutter head 2 is movable from an out-of-the-way position disposed beyond the other end of the bundle of products 10 and is movable from the out-of-the-way position toward the plate 3*b* during the process of cutting the window 5 (FIG. 3) in the wrapping 11. The plate 3*b* provides a back stop against which the bundle of products 10 will tend to be urged during the cutting process.

The plate 3*b* is able to grip or be rotatably coupled to the end of the bundle of products 10 so that rotation of the shaft 3*a* provides for rotation of the bundle of products 10. This allows control of the location of the window 5 with respect to a rotational position thereof about the longitudinal axis. Further, the blade 8*b* for cutting the perpendicular cut line of the window 5 is able to be engaged with the wrapping 11 whilst the shaft 3*a* is rotated to thereby control a rotational extent of the perpendicular cut line. The longitudinal extent of the parallel cut lines can be controlled by the extent of longitudinal movement of the cutter head 2 with the blades 8*a* engaged in the wrapping 11. More than one bundle of products 10 can therefore be held and cut with the same direction of movement of the cutter head 2, for example.

Figure 4:
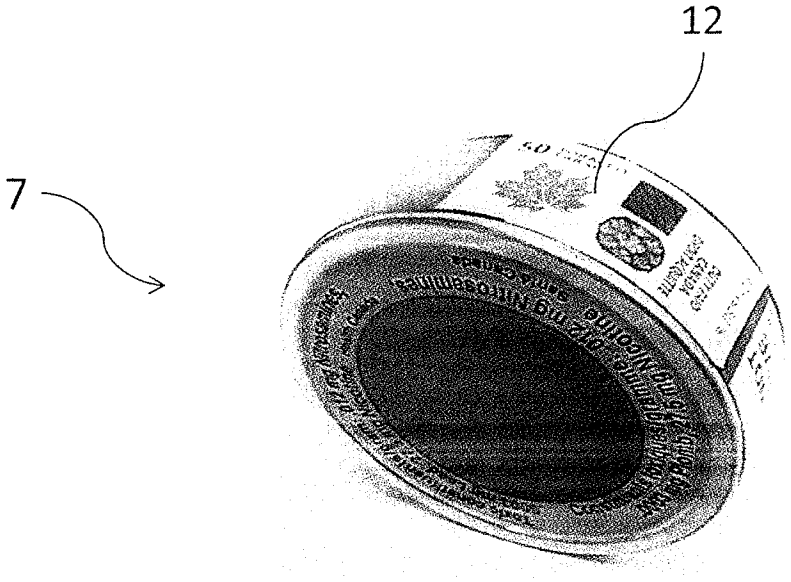
FIG. 4 shows an exemplary product that is disposable within the wrapping, and which has a label applied to it in accordance with aspects of the disclosure. In the example of FIG. 4, the label is a tax label comprising plural security features for preventing counterfeiting. The product is a tinned or canned tobacco product, where the tin or can is in puck form.

Referring to FIG. 4, there is shown a product 7 that is a tinned or canned tobacco product 7. In certain jurisdictions, tax labels 12 are to be applied to the outside of the tin or can. In the example shown, a tax label 12 has been applied. The tax label 12 comprises a number of anti-counterfeit security features, which may be overt and/or covert security features. The security features may be applied to the tax label 12 by printing. The tax label 12 is an adhesive label that has been adhered to the outside surface of the tin or can 7.

The product 7 shown in FIG. 4 has a puck form, in that the tin or can has a smaller height dimension than a diameter dimension, and is thus "puck" shaped.

A plurality of the products 7 shown in FIG. 4 are stacked on top of one another and formed into a bundle of products 10 that are held together by a wrapping 11 disposed thereabout. The apparatus of FIGS. 1 to 3 is usable so as to cut a window 5 in the wrapping 11 whilst maintaining the integrity of the wrapping in so far as the products 7 remain held together thereby. The window 5 is able to be opened in a flap-like manner so that the labels 12 can be applied through the window to each of the products 7 in the bundle of products 10.

Referring to FIG. 3, the window 5 cut by the apparatus of FIGS. 1 and 2 begins adjacent, but not at, one end of the bundle of products 10 and ends adjacent the opposed end of the bundle of products 10. By forming the window 5 in this manner, there exists at each end of the bundle of products 10 connecting portions (not shown) of the wrapping 11 bridging the window 5 to ensure that the bundle of products 10 remains held together in the circumferential direction. The connecting portion of the wrapping may be only a few millimeters in length, for example 2-3 mm. The window 5 is formed so as to be long enough to allow access to each of the products 7 in the bundle of products 10 and is wide enough so as to accommodate the width of the labels 12. Furthermore, the window 5 is formed by cutting a flap 6 that is connected to the rest of the wrapping at one end to allow the window 5 to be opened by pulling the flap 6 away from the bundle of products 10. The wrapping 11 can then be re-closed by covering the flap 6 back on to the part of the bundle of products 10 that had been exposed by the opened flap 6.

A method of use of the apparatus of FIGS. 1 and 2 will be described in the following, as well as a method of applying labels to products underlying an outer wrapping.

The apparatus of FIGS. 1 and 2 is used by placing the bundle of products 10 in the support 1. A first end of the bundle of products 10 is disposed in abutting relation with the plate 3*b*. The cutter 2 is initially disposed in an out-of-the-way position longitudinally spaced from the other end of the bundle of products 10.

The cutter head 2 is moved along the longitudinal axis towards the plate 3*b* while applying a slight downward pressure to the cutter 2 at the start of the wrapping 11 to pierce the wrapping 11 with the blades 8*a* adjacent the end of the bundle of products 10. The cutter 2 continues to be moved along the rail guide 4 with the downward pressure applied to cut parallel longitudinal cuts in the wrapping 11 to partly form the window 5. The apparatus is operated so that the parallel cut lines extend from a location adjacent one end of the bundle of products 10 to a location adjacent the other end of the bundle of products to allow later exposure of each of the individual underlying products 7. During operation of the blade 8*a* whilst the cutter head 2 is moving in the longitudinal direction, the blade 8*b* does not engage the wrapping 11.

Once the parallel cut lines in the wrapping 11 are formed with sufficient length, i.e. when the cutter head 2 is positioned adjacent the plate 3*b*, the cutter head 2 is tilted so that the blade 8*b* pierces the wrapping 11. Tilting of the cutter head 2 such that the blade 8*b* pierces the wrapping 11 may also cause the blades 8*a* to be removed from engagement with the wrapping 11. Alternatively, removal of downward pressure from the location of the cutter head above the blades 8*a* may cause these blades 8*a* to be biased out of engagement from the wrapping 11. The rotatable shaft 3*a* is rotated to rotate the bundle of products 10 to extend the cut formed by the blade 8*b* in the rotational direction. In particular, the cut line formed by the blade 8*b* is extended so as to connect the two parallel cut lines formed by the blades 8*a* to thereby form a flap 6 as shown in FIG. 3.

The cutter head 2 is then moved back to the out-of-the-way position shown in FIG. 1 along the rail guides 4 without applying downward pressure so that the blades 8*a*, 8*b* do not further cut the wrapping 11.

The flap 6 is moved away from the bundle of products 10 to open the window 5 to expose each of the underlying individual products 7. A label 12 is applied through the open window 5 to each of the underlying products. The window 5 is repositioned to cover the exposed part of the bundle of products 10 to thereby close the window 5. The flap 6 is attached in the reclosed positioned by application of adhesive tape or other fixer.

In the above, a window has been cut into the bundle of products 10 and labels applied through the window by using the apparatus of the FIGS. 1 and 2. The method of the present disclosure is more generally applicable than it being performed by using the specific apparatus of FIGS. 1 and 2. A method may be provided that uses an apparatus other than that in FIGS. 1 and 2. The method aspects of the present disclosure are independently advantageous of the apparatus, in providing a way of applying labels to products underlying outer wrapping that maintains the wrapping and that is efficient to process. The concept of cutting a window in the wrapping and applying labels through the window to the underlying products is not, to Applicant's knowledge, known in the art.

Accordingly, an embodiment of the method of the present disclosure includes moving a cutter head 2 relative to a bundle of products 10 to form a window 5 therein, as shown in FIG. 3. Two parallel cut lines that extend along a longitudinal axis of the bundle of products 10 are simultaneously formed with a single sweep of the cutter head 2. A circumferential cut line connecting the two parallel cut lines may be formed in a separate cutting step. The circumferential cut line may be formed by rotating the bundle of products 10 whilst the wrapping 11 is pierced with a cutting blade. Advantageously, only three sides of a window 5 are cut in the wrapping 11 so that a flap 6 is formed that remains connected to the rest of the wrapping 11 at one end. The flap 6 is pulled away from the bundle of products 10 to open the window 5. Labels are applied to each of the individual products 7 underlying the wrapping 11 through the open window 5. The flap 6 is re-closed and fixed in the re-closed position, perhaps by application of adhesive tape or other fixer.

In the method, the window 5 is cut so that connecting portions exists at one or both ends of the bundle of products 10 at the location of the window 5 to provide material bridging the window 5 to maintain the function of the wrapping 11 in holding the products 7 together.

Various alternatives for the disclosed embodiments could be provided. The support 1 is described as having a trough-like form. Other shapes or arrangements that allow the bundle of products 10 to be laterally restrained could also be provided. The trough-like form for the support 1 is advantageous in providing opposed converging walls for self-centering of the bundle of products 10 placed therein.

Referring to FIG. 1, the blades 8*a* are shown as being parallel blades, in that they have a longitudinal extent that is parallel with one another. Likewise, the blade 8*b* is described as being a blade perpendicularly oriented with respect to the parallel blade 8*a*. Blades having such longitudinal and lateral extents are not, however, essential to implementing the present disclosure. The blade 8*a* and 8*b* could be provided in a much reduced form in terms of longitudinal/lateral extent. What is important is that these blades 8*a*, 8*b* are able to produce longitudinal and lateral cuts and this could be performed without necessarily requiring longitudinally and laterally oriented blades. For example, opposed blades 8*a* that are able to pierce the wrapping 11 could be provided with very little longitudinal extent, and the longitudinal extent of the parallel cut lines is provided by the longitudinal motion of the cutter head 2 relative to the support 1 and the bundle of products 10. Similarly, the blade 8*b* could have very little lateral extent and the lateral extent of the cutter and the wrapping 11 could be provided by the degree of rotation of the shaft 3*a* and the bundle of products 10.

In the embodiment described above with respect to FIGS. 1 and 2, the cutter head 2 is able to be tilted in order to allow the blade 8*b* to be brought into engagement with the wrapping 11 when required, but where this blade 8*b* does not cut the wrapping 11 when the parallel cut lines are being created using the blades 8*a*, and vice versa. An alternative implementation of this functionality could be provided by a blade that is movable between a retracted position and an extended position by moving it relative to the cutter head 2 so that the blade 8*b* can be selectively applied when required and moved into a retracted position when the parallel cut lines are being formed. A further implementation is that the blades 8*a*, 8*b* are biased away from the wrapping, and application of pressure in selected locations on the cutter head 2 is needed to bring these blades into engagement with the wrapping 11.

An alternative embodiment is also envisaged in which the window 5 is die cut into the wrapping 11. Such an embodiment would involve the cutter head being moved into a position engaging and cutting the wrapping 11 to form the window 5 and being moved into an out-of-the-way position in order to apply the labels. Such a window 5 could be thus formed in a single moving step.

In the apparatus described above, the distance between the blade 8*a* with respect to the cutter head 2 is described as being adjustable, while the circumferential extent of the perpendicular cut line is defined by selecting an amount of rotation of the rotatable shaft 3*a*. The distance between the blades 8*a* may also be adjustable, in order to form different widths of windows in the wrapping 11. This would increase the range of products the device could be used on. In less adjustable embodiments, for example in implementations where the length and diameter of the bundle of products 10 is fixed, the spacing between the blades 8*a* could also be fixed, while the blade 8*b* could be selected to have a circumferential extent fully spanning the blades 8*a*. In this embodiment, a rotational shaft 3*a* would not be necessary as the perpendicular cut line could be performed simply by engaging the blade 8*b* with the wrapping.

The apparatus of FIGS. 1 and 2 is primarily designed for hand operation. That is, the cutter head 2 is moved along the guide rails 4 by hand and the rotation of the shaft 3*a* is similarly manually operated. Automated implementations of the present disclosure are, however, envisaged. Motion of the cutter head 2 could be performed by machine operation, as could rotation of the shaft 3*a*. Further, placement of the bundle of products 10 could also be performed by an automated machine. Accordingly, the claims of the present disclosure are not to be construed as being limited to manual implementations. For example, the above apparatus may be enhanced by the movement of cutter head 2 and the rotation shaft 3*a* or other rotator being performed automatically, for example, using a stepper motor.

The present embodiments have been described with respect to a particular type of products, namely puck-formed tobacco products as shown in FIG. 4. Other shaped tins or cans could equally be used with the apparatus and method of the present disclosure. Furthermore, other types of packaging than tins or cans may also be subject to the concepts described herein. Still further, multiple bundles of products could be held and cut with one movement of the cutter head 2. In the implementation, a spring plate holder is envisaged to ensure the holding plate holds the bundle of pucks securely in place. The cutter head 2 could be manipulated so as to cut separate windows in each bundle. Accordingly, the present disclosure is applicable to more generally defined products that have a wrapping disposed thereabout, wherein a label is applied to each of the one or more products in the wrapping through the window.

Furthermore, the preferred embodiments of the present disclosure make use of the formation of a flap since this allows for convenient and material efficient re-sealing of the wrapping 11. Other forms for the window can, however, be envisaged. For example the window could be formed by cutting out an entirely severed piece of material, with that piece of material either being replaced during the closing of the window or being replaced by an alternative piece of material such as adhesive tape.

In the embodiment of FIGS. 1 and 2, the apparatus comprises a stationary support and a moveable cutter. Relative movement between the bundle and the cutter head in order to cut the window could be implemented alternatively. For example, the support could comprise a conveyor for conveying the products to the cutter head, which is a stationary component. The a conveyor could still comprise converging walls to hold the bundle laterally stable (with the relative motion of the bundle and the cutter being longitudinal movement). A conveyor could be operative to then transport the bundle to a label application station, which could comprise an automated label applicator.

An automated re-closer for reclosing the window could be provided. This could be an applicator for applying a cover over the window or an automated re-closer for reclosing the flap and sealing the flap by adhesive applicator.

The invention claimed is:

1. An apparatus, comprising:

a support for one or more products, the one or more products having a wrapping, and a cutter coupled to the support and moveable relative to the support to form a window in the wrapping and to allow access for placing one or more labels on the one or more products, wherein the apparatus further comprises a rotatable shaft or other rotator configured to rotate the one or more products having the wrapping.

2. The apparatus according to claim 1, wherein the support is provided in the form of a trough, wherein at least two sides of the trough are configured to support the one or more products from at least two sides, and wherein at least one side of the trough is structured and arranged to allow the cutter to access to the wrapping.

3. The apparatus according to claim 1, wherein the cutter comprises at least one blade that is:

arranged to be moved into cutting relation with the wrapping to form a cut through the wrapping, and configured to be moved thereafter relative to the one or more products to extend the cut in the wrapping to form at least part of the window.

4. The apparatus according to claim 1, wherein the cutter includes first and second blades to form opposed sides of the window, and wherein the first and second blades are arranged to be brought into cutting relation with the wrapping and to be moved in tandem relative to the one or more products to form opposed, cut lines, which cut lines form opposed sides of the window.

5. The apparatus according to claim 4, wherein the opposed cut lines are parallel cut lines.

6. The apparatus according to claim 1, wherein the cutter comprises a leading blade, wherein the leading blade is arranged to cut perpendicular to a movement direction of the cutter.

7. The apparatus of claim 6, wherein the leading blade is movable between a first position where the leading blade is not in contact with the wrapping and a second position where the leading blade is in contact with the wrapping.

8. The apparatus of claim 7, wherein rotation of the one or more products having the wrapping thereabout allows the wrapping to be cut by the leading blade, when the leading blade is in the second position.

9. The apparatus according to claim 1, wherein:

the cutter comprises a head upon which at least one blade is mounted, the head is moveable relative to the one or more products when arranged in the support in order to create at least part of the window, and the head comprises at least two blades to cut respective parts of the window as the head is moved relative to the products.

10. The apparatus according to claim 9, wherein the head comprises three blades.

11. The apparatus according to claim 1, wherein the cutter is arranged to be moveable into cutting relation with the wrapping to form the window and is moveable into an out-of-the-way position to provide access for applying labels to the one or more products.

12. The apparatus according to claim 1, further comprising a guide for guiding movement of the cutter in forming at least part of the window.

13. The apparatus according to claim 12, wherein the guide comprises a rail along which the cutter is moveable.

14. The apparatus according to claim 12, wherein the guide and the cutter are arranged such that the cutter is moveable relative to the guide to form at least three sides of the window.

15. The apparatus according to claim 1, wherein the apparatus is configured to allow formation of only three sides of the window to form a flap that remains connected to the wrapping to allow the flap to be opened for application of one or more labels and reclosed thereafter.

16. A method of using the apparatus according to claim 1, the method comprising:

moving the cutter relative to the support to form at least part of the window in the wrapping, and applying one or more labels to the underlying products through the window.

17. A method of using the apparatus according to claim 1, the method comprising:

providing one or more products having a wrapping thereabout;

forming a window in the wrapping; and applying one or more labels on the one or more products through the window.

18. The method of claim 17, wherein the forming comprises forming a flap, and the method further comprises opening the flap relative to the wrapping to provide access for applying the one or more labels to the underlying one or more products.

19. The method of claim 17, wherein:

the one or more products comprises a plurality of products, the wrapping holds together the plurality of products before the window is formed, and the wrapping continues to hold together the plurality of products while the window is formed.

20. The method of claim 17, wherein the forming comprises cutting a strip of the wrapping to form the window in the wrapping.

21. The method of claim 17, further comprising closing the window after the labels have been applied.

22. The method of claim 17, wherein the forming the window comprises cutting the wrapping, and the method further comprises opening a cut portion of the wrapping to provide access for the applying the one or more labels.

23. The method of claim 22, further comprising reclosing and attaching the cut portion of the wrapping to surrounding wrapping to reclose the window.

24. The method of claim 17, wherein the forming the window comprises cutting a flap in the wrapping, and the method further comprises:

opening the flap to provide access for the applying the labels, wherein the applying the labels is through the access; and reclosing the flap to cover the access.

25. The method of claim 17, wherein:

the products are in the form of at least four items that are bundled together in the wrapping, the products are tinned or canned products, the products are stacked products held together in a stacked configuration by the wrapping, and the wrapping comprises a sleeve about the products.

26. The method of claim 17, wherein the products are tobacco products.

27. The method of claim 17, wherein the labels comprise tax labels.

28. The method of claim 17, wherein the wrapping continues to hold together the plurality of products after the window is formed.

* * * * *